US008359994B1

(12) United States Patent
Highfield

(10) Patent No.: US 8,359,994 B1
(45) Date of Patent: Jan. 29, 2013

(54) RETRACTABLE PONTOON BOAT COVER

(76) Inventor: John Highfield, Gladwin, MI (US)

( * ) Notice: Subject to any disclaimer, the term of this patent is extended or adjusted under 35 U.S.C. 154(b) by 155 days.

(21) Appl. No.: 13/029,630

(22) Filed: Feb. 17, 2011

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 4,091,484 A 5/1978 Means
4,979,456 A 12/1990 Steward
5,850,799 A * 12/1998 Geisel et al. ..... 114/361
6,209,477 B1 4/2001 Biedenweg
6,260,505 B1 7/2001 Polidan
6,588,361 B2 7/2003 Biedenweg
7,249,568 B1 7/2007 Cultrara
7,484,472 B1 2/2009 Highfield
2002/0053313 A1 5/2002 Murphy et al.

* cited by examiner

*Primary Examiner* — Lars A Olson

(57) ABSTRACT

A retractable cover system for a pontoon boat comprising an expanding frame of U-shaped supports sliding in tracks along the sides of the boat, the U-shaped supports interconnected by expanding scissors. The bow and stern ends of the frame are provided with pivoting sections that include horizontal and angled U-shaped supports to define fabric-supporting and fabric-securing structure at the bow and stern of the boat when the frame is fully extended. The retracted frame and fabric cover self-store at the stern of the boat by tilting a pivot station portion of the track rearwardly.

13 Claims, 9 Drawing Sheets

RETRACTABLE PONTOON BOAT COVER

RELATED APPLICATIONS/PRIORITY BENEFIT CLAIM

None.

FIELD

The subject matter of the present application is in the field of retractable fabric covers for pontoon boats.

BACKGROUND

It is well known to provide a boat with a cover to prevent water and other debris from collecting inside the boat when the boat is not in use. A recent example is shown in my U.S. Pat. No. 7,484,472 B1. This particular cover is a manually-operated version of a retractable pontoon boat cover system. This cover system uses an expanding frame system to cover and uncover a pontoon boat. This frame system includes a plurality of U-shaped supports mounted to a device that causes directional movement, the device attachably fixed on the port and starboard sides of the boat's deck.

The retractable cover in my '472 patent has a stowing compartment removably fixed to the bow of the boat, and the expanding frame system and attached fabric cover pivots into and out of the storage compartment.

I have learned that the system in my '472 patent has some disadvantages. For example, the U-shaped tube sections are not connected to each other, and each tube section travels independently, which results in unequal forward as well as side-to-side motion when the sections are extending and retracting over the boat. This unequal movement causes binding issues in the track apparatus.

The U-shaped supports in my '472 patent each comprise a single elongate member, which exacerbates the problem of unequal side-to-side motion. For example, if the port side of the frame system were to advance at a faster rate than the starboard side, the unequal motion would cause one or both sides to bind in the track apparatus.

The framework in my '472 patent also lacks adequate support for the attachable fabric in the front and rear of the structure, allowing water and other debris, i.e., leaves, branches etc. to collect between the first vertical support and the front stowing compartment, and between the last vertical support and the rear horizontal support.

The rear horizontal tube section in my '472 patent is unsecured when extended to support the fabric cover, and therefore is subject to wind causing this part of the cover to lift during heavy winds.

Another drawback of the retractable cover system in my '472 patent is the location of the cover's storage position. The expanding frame system stores in a U-shaped stowing compartment detachably fixed to the bow of the boat. This stowing compartment or box is costly and presents a number of problems. The design and style of this compartment is not universal and would require several different variations to outfit different brands of pontoon boats. The stowing compartment extends a distance beyond the sides of the pontoon boat and would require a wide load permit for transportation to and from any desired location. The bottom of the stowing compartment extends a distance beneath the boat's deck and any transportation unit such as a boat trailer would need to be modified to become an appropriate transportation vehicle.

Furthermore the bow storage location could incur damage as the bow contacts outside structures such as docks or other boats.

BRIEF SUMMARY

It is the intent of the present invention to address the aforementioned problems with the expanding frame system of my '472 patent.

The retractable pontoon boat cover of the present invention comprises an expanding frame system attached to both sides of the boat through a track apparatus fastened horizontally to the sides of the boat, for example along the edges of the deck. The frame system includes a plurality of U-shaped vertical support members designed to span the width of the boat, and to move fore and aft on the track. The vertical support members comprise vertical tube sections on the sides of the boat, each pair of vertical tube sections connected by an arched formation spanning the width of the boat. The U-shaped support members are interconnected with expanding scissors and sliding sleeves. The expanding scissors are placed between each vertical tube section on the port and starboard sides of the frame. The expanding scissors are attached to the bases (lower ends) of the vertical tube sections, oriented so the bottom portion of one side of a scissor is connected to the base of one vertical tube section and the bottom portion of the other side of the scissor is connected to the base of the adjacent vertical tube section. The tops of the expanding scissors are connected to sliding sleeves. The sliding sleeves are located midway on each vertical tube section and move in an up and down vertical motion when the expanding frame is extended or retracted. All standing vertical tube sections on both the port and starboard sides of the expanding frame system are connected in this fashion. The interconnection of the U-shaped vertical support members with the expanding scissor and sliding sleeve connection causes the frame system to move as a single unit when extended and retracted, and eliminates unequal side-to-side movement.

A further feature of the present invention is a U-shaped support constructed of two or more sections, which allows the expanding frame to extend and retract without binding if one side of the expanding frame advances at a faster rate than the other side.

Front and rear pivoting support sections are located in the front and rear of the expanding frame structure, comprising "angled" and "horizontal" U-shaped supports. The angled supports are located in-between the first (front) vertical support and the front horizontal support and the last (rear) vertical support and the rear horizontal support. These horizontal supports deploy to horizontal positions holding the cover fabric to the deck, and the angled supports deploy to an angled (e.g., 45-degree) fabric supporting position and interconnect the horizontal supports and the adjacent first and last vertical supports, by means of pivot structure located in the front and rear corners of the expanding frame structure. Springs extending between the vertical tube sections of the first and last vertical supports and the pivoting tube sections assist the pivoting motion during expansion and retraction of the expanding frame system.

To accomplish an improved pivot motion when the cover is expanded, and to latch the expanded cover in place, the front pivot section includes a front pivot arm cooperating with a front pivot guide. The front pivot arm is located at the base of the front side of the expanding frame system on each of the port and starboard sides. The front pivot arm is attached to the front pivot section and travels inside the track apparatus when the expanding frame is expanding or retracting. The front pivot guide is located at the front end of the track apparatus, when the expanding frame reaches full extension the front pivot arm engages the front pivot guide. The front pivot arm is guided to rotate down into the front pivot guide, and is latched in place by the deployment of the front angled support behind it, which allows for a more precise pivoting mechanism and also provides an efficient locking latch system. When the pivot arm is thus engaged with the pivot guide it prevents outside elements such as wind from lifting the front of the cover system.

The rear pivot system is equipped with a rear link. This link attaches to the rear sliding sleeve at one end and to the last horizontal tube section at the other end. The function of the rear link is twofold. The first function of the rear link is to automatically pivot the rear pivot section using the upward and downward motion of the sliding sleeve. The second function of the rear link is a latch system retaining the rear pivot when the cover is in an extended position, which prevents the rear of the cover from lifting due to heavy winds.

The cover system can be extended and retracted manually, but is preferably operated by an automatic motor-driven system comprising: motors, a drive slide, a drive pin, a power transmission system, and optionally a wireless remote and receiver. The gear motors are located on motor mounts, and the motor mounts are connected to the aft end of the track apparatus. The transmission system (for example, a belt or chain driven by the associated motor) extends from the motor shaft to the front pivot guide and returns to the motor shafts, which provide forward and reverse movement when the motors are activated. Attached to the transmission system is the drive slide, and attached to the bottom of the first vertical tube section is the drive pin. The drive pin engages the drive slide, for example via a slot.

The optional wireless receiver is connected to a power source and to the gear motors on each side of the boat. The wireless receiver is activated using a wireless key fob or equivalent. The key fob has forward and reverse capabilities. When the key fob is activated the wireless receiver activates the gear motors in the desired direction. The gear motors activate the transmission system and the drive slide causes the expanding frame to extend and retract by means of the connection between the drive slide and the drive pin.

The preferred embodiment has a rear storage position. When retracting, the expanding frame system gathers towards the aft of the boat in a pivot station located at the rear of the track apparatus. When full retraction is achieved, the expanding frame system is secured and the pivot station allows the frame system to pivot backwards at an angle to the preferred storage location.

The frame system is designed to receive a flexible fabric cover. The flexible fabric cover has a plurality of attachment pockets and grommet holes spaced out at equal distances as a manner of attachment to the frame system. The fabric cover also has a plurality of fabric stays spaced out at equal distances. The stays provide outward pressure to the fabric in the desired locations, to effect the fabric to fold outward as the expanding frame system retracts. As the retraction proceeds the stays cause the fabric material to fold outward in an orderly fashion.

These and other features and advantages of the invention will become apparent from the detailed description below, in light of the accompanying drawings.

DETAILED DESCRIPTION

Figure 1:
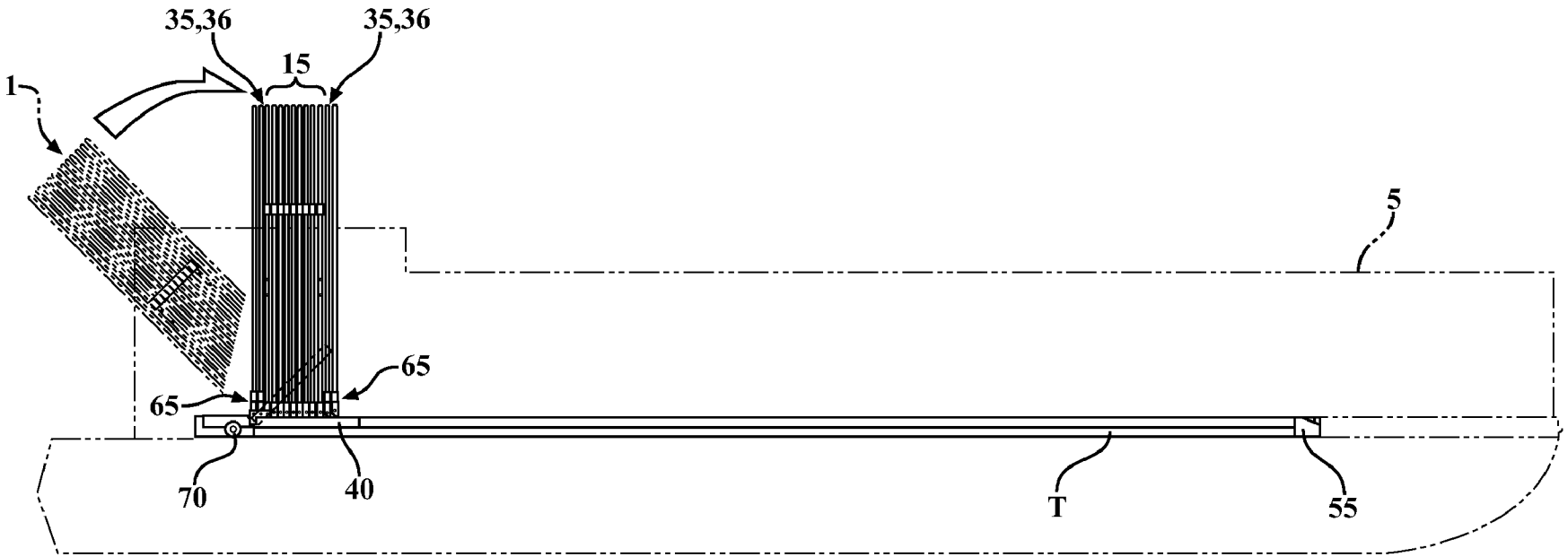
FIG. 1 is a side elevation view of a pontoon boat with retractable cover according to the invention, with the frame portion of the cover shown in a retracted (vertical) position in solid lines and a storage (angled) position in phantom lines, and the fabric portion removed for clarity.
Figure 2:
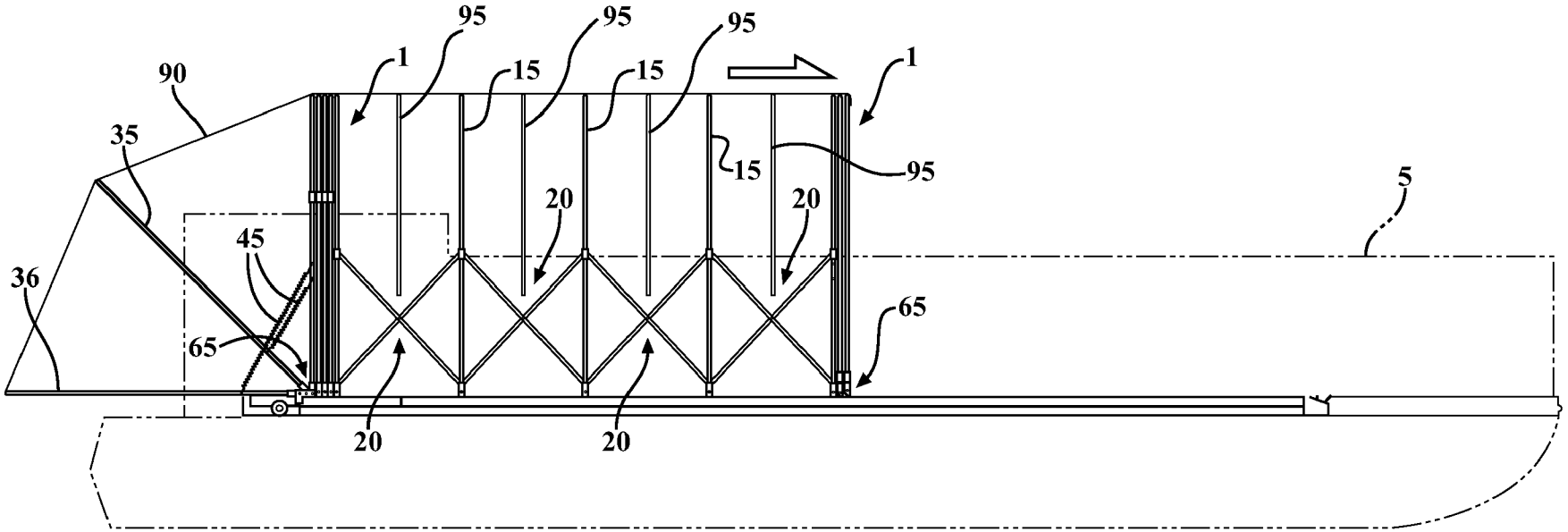
FIG. 2 is similar to FIG. 1, but with the frame in a partially-extended position and the fabric portion shown in outline only.
Figure 3:
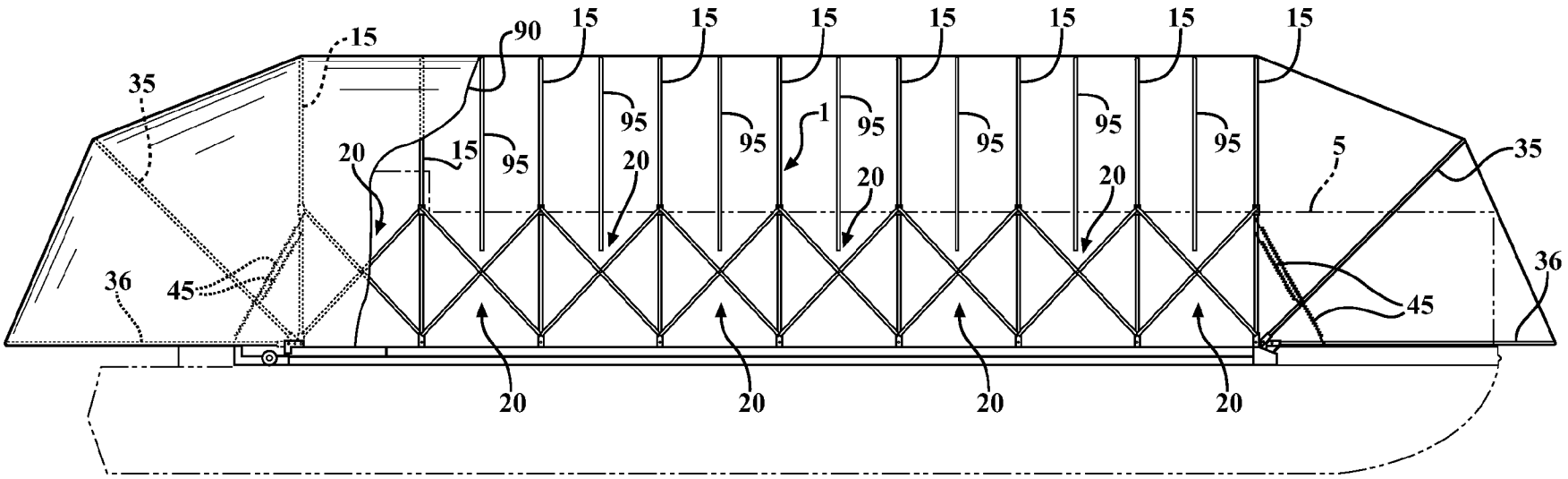
FIG. 3 is similar to FIG. 2, but with the cover in a fully-extended position over the full length of the pontoon boat, and the fabric portion shown partially cut away at the rear or stern of the boat.

Referring first to FIGS. 1 through 3, a retractable boat cover is shown in exemplary form in order to teach how to make and use the claimed invention.

Looking at FIGS. 1-3, there is shown a typical pontoon boat (5) in outline schematic form. A cover system is provided that includes an expanding frame (1). The expanding frame (1) is designed to receive a flexible fabric cover (90) shown in outline in FIG. 2 and in further in cutaway in FIG. 3.

FIG. 1 shows the frame 1 in a fully-retracted position in solid lines, and in a storage position in which the fully-retracted frame 1 is tilted rearwardly at an approximately 45-degree angle. Frame 1 includes vertical supports (15) and front and rear pivot sections (65) including angle-deployed supports (35) and horizontally-deployed supports (36). FIG. 2 shows frame 1 partially extended along the length of the pontoon boat 5. FIG. 3 shows the fully-extended frame, with vertical support members (15) and the front and rear pivot sections (65) fully deployed. FIGS. 2 and 3 also show springs (45) which aid in the upward motion of the front and rear horizontal U shaped supports (36). Springs (45) are connected from the front and rear horizontal U shaped support (36) to the vertical side tube sections (30) of the first and last vertical supports (15) on all corners of the expanding frame.

The flexible fabric cover (90) has a plurality of fabric stays (95) spaced out at equal distances. The fabric stays (95) effect a unified folding process as the expanding frame (1) extends and retracts.

Figure 4:
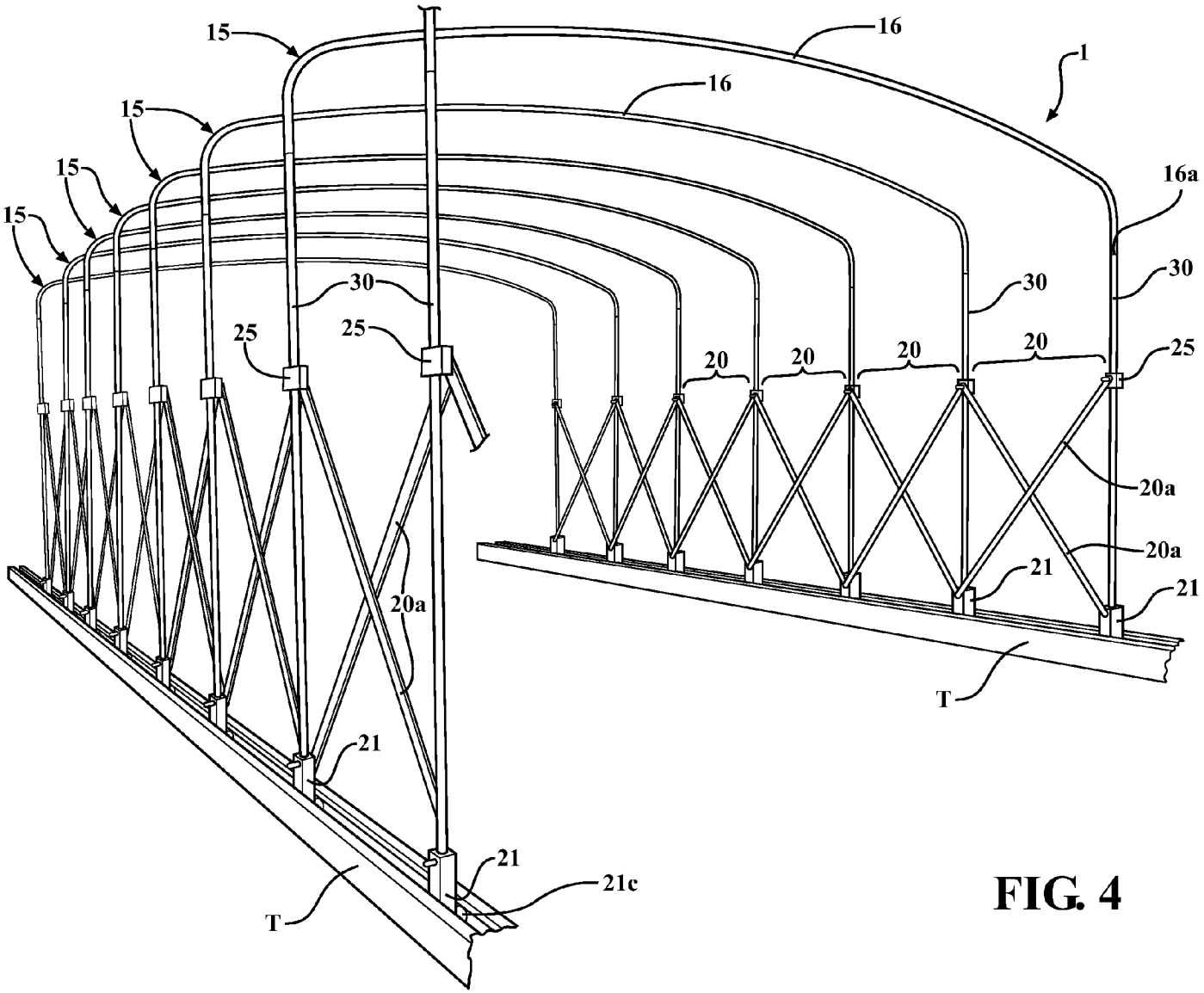
FIG. 4 is a perspective view of the fully extended vertical supports of the frame of FIG. 1.
Figure 5:
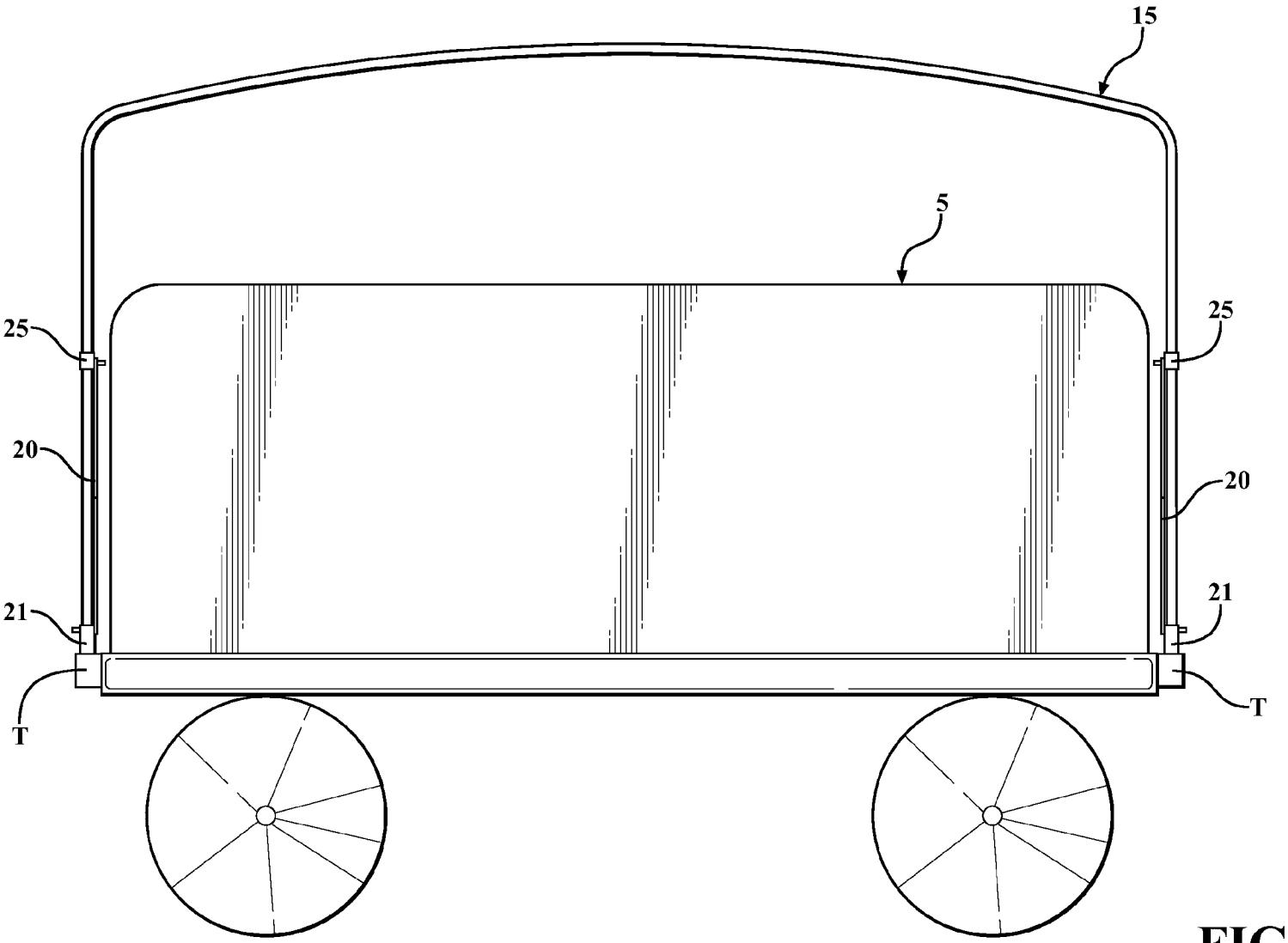
FIG. 5 is a front end view of the vertical supports of FIG. 4.

FIGS. 4 and 5 depict the vertical supports (15) of the expanding frame (1), without the flexible fabric cover (90). The expanding frame (1) has a plurality of U shaped vertical supports (15) that span the width of the boat. Each U shaped support (15) comprises a vertical tube section (30) on both the port and starboard sides of the expanding frame (1) and an arch tube (16) connecting the port and starboard sides. "Tube" should be construed broadly, and can included cylindrical and non-cylindrical and hollow and solid supports. In the illustrated example, supports (15) are formed from hollow aluminum tubing. Each arch tube (16) has an arched formation or shape to discourage the pooling of water on the fabric which they support. Arch tubes (16) preferably have a movable or rotating connection with side tubes (30), for example with a cylindrical friction fit or plug fitting at joint (16*a*), to prevent binding of the frame during expansion and retraction.

Interconnecting the U shaped supports (15) are the expanding scissors (20) each comprising pivoting cross-members (20*a*). The lower ends of the pivoting cross-members (20*a*) are pivotally attached to mounts such as blocks (21) fixed to the lower ends or bases of the vertical tube sections (30) and adapted to travel in tracks (T), for example on attached rollers (21*c*), and the upper ends of the pivoting cross-members (20*a*) are pivotally mounted to the vertical tube sections (30) by sliding members or sleeves (25) that can slide freely up and down the vertical tube sections (30). The combination of the expanding scissors (20) and the sliding sleeves (25) interconnecting each of the U-shaped vertical frame supports (15) causes the expanding frame (1) to expand and contract in a precise and orderly fashion as blocks (21) travel down tracks (T) along the length of the pontoon boat (5), eliminating unequal side to side movement of the individual frame supports (15) and the attached fabric cover.

The cross-members (20*a*) of each expanding scissors (20) need not be pivotally connected to each other where they intersect, although optionally they could be.

The bow and aft ends of the frame (1) include pivot sections (65) comprising a U-shaped horizontal support member (36) and a U-shaped angled fabric support (35), deployed on the bow and aft ends of the pontoon boat (5) when frame (1) is fully expanded, best shown in FIG. 3. Angled supports (35) provide additional support to the flexible fabric cover (90) at the ends of the boat, and horizontal supports (36) help hold the ends of the fabric cover (90) to the deck of the boat. Horizontal supports (36) are pivotally connected to their pivot sections with pivoting blocks (21*b*), and angled supports (35) are connected to their pivot sections with pivoting blocks (21*a*).

Figure 6:
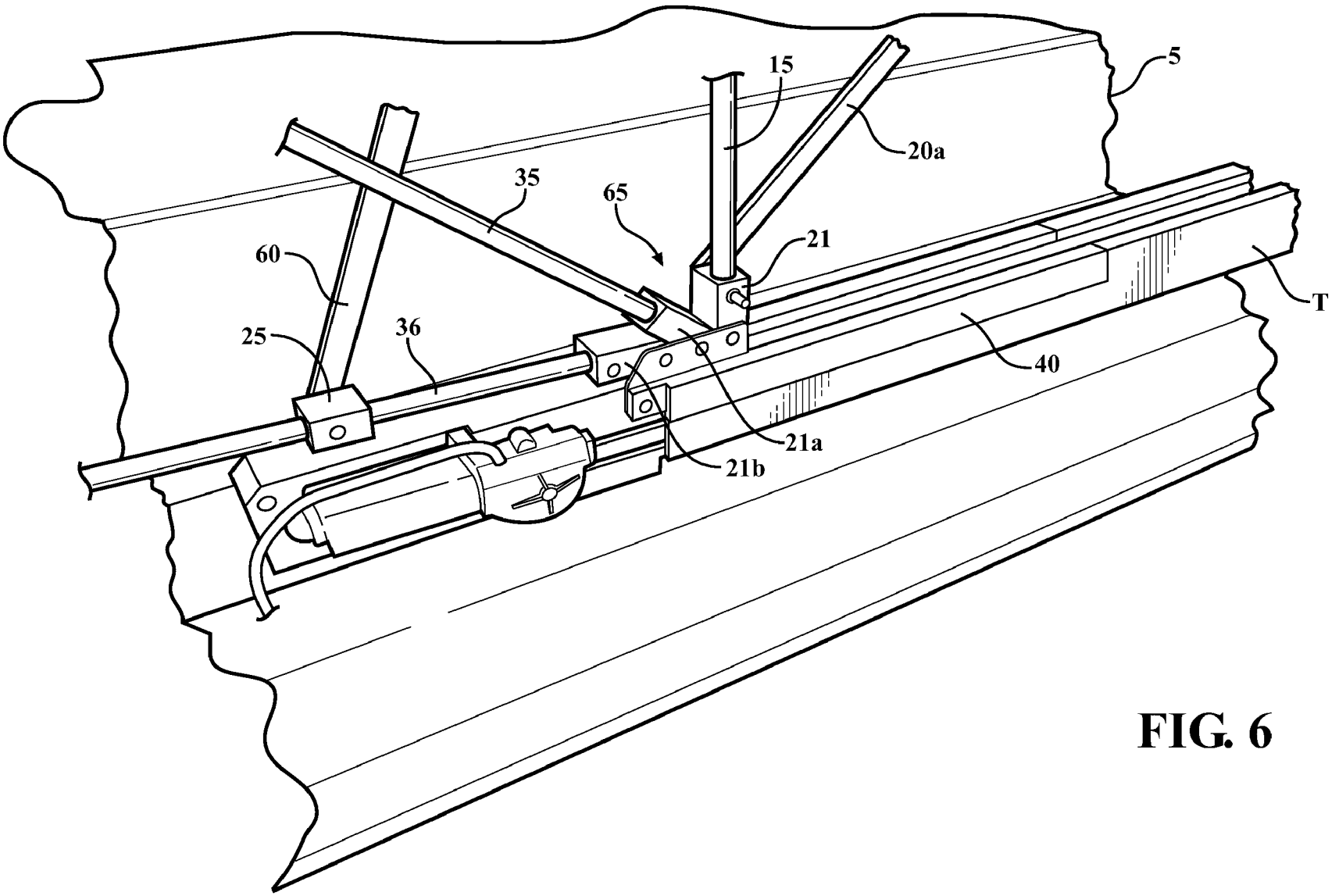
FIG. 6 is a detail rear perspective view of the rear pivot station and motor structure, and a rear pivot section in the cover-extended position.

FIG. 6 shows detail of the rear pivot section (65) in the fully extended position. When the expanding frame (1) is fully extended the rear pivot section (65) distributes the rear forty-five degree U-shaped support (35) and rear horizontal U-shaped support (36) in their proper positions. A rear link (60), optionally supplemented with a spring (45), is located between the rear horizontal U-shaped support (36) and the sliding sleeve (25) of the last vertical tube section (30). This connection allows the automatic placement of the rear horizontal U-shaped support (36) during expansion and retraction of the expanding frame (1).

Figure 6A:
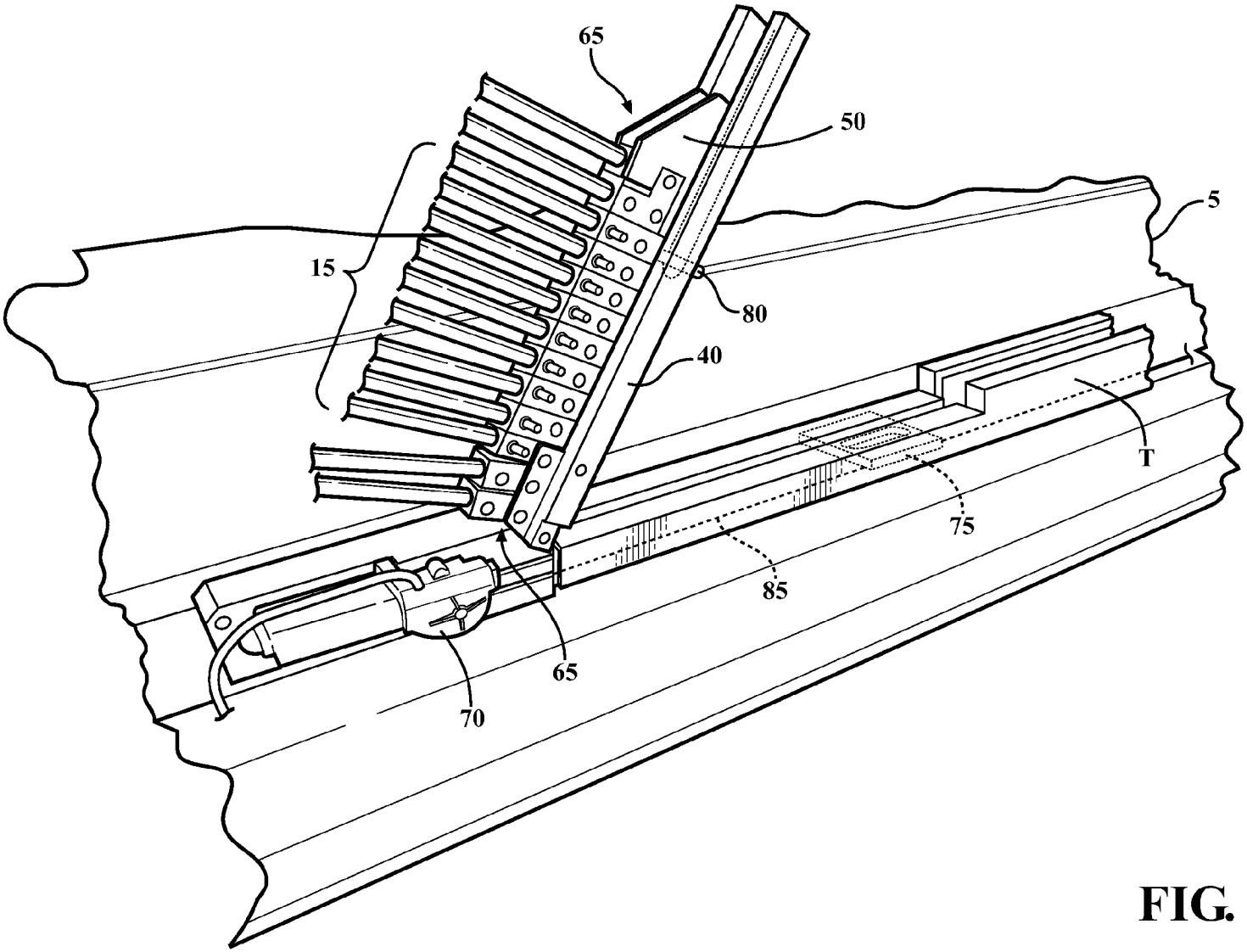
FIG. 6A is similar to FIG. 6, but with the frame retracted into the rear pivot station and tilted to the storage position.

FIG. 6A shows the expanding frame (1) fully retracted and rear pivot station (40) in the tilted storage position. Rear pivot station (40) holds all of the U-shaped vertical supports (15) and the front and rear pivot sections (65) of frame (1) when the frame is fully retracted, and pivots up and back out of engagement with track (T) to the storage position shown in phantom lines in FIG. 1. When extending the expanding frame (1), the rear pivot station (40) is pivoted down to the horizontal position shown in FIG. 6, engaging track (T). A drive pin (80) attached to the travel block (21) of the leading U-shaped vertical support (15) in frame (1) engages a slot (75*a*) in a drive slide (75) that rides in track (T) and that is operatively connected to and driven by motor (70) by a transmission means (85), for example a drive belt or chain rotating around a pulley (85*a*) in the front pivot guide (55) at the front end of the track (T) (see FIG. 7A). Forward and reverse motion of the drive slide (75) occurs when the gear motor (70) is activated and directs the power transmission belt (85) to advance the drive slide (75) in a forward or reverse direction along track (T). It will be understood that each side of pontoon boat (5) is equipped with track (T) and the associated pivot station, drive slide and motor structure at the rear end of the track.

Figure 7:
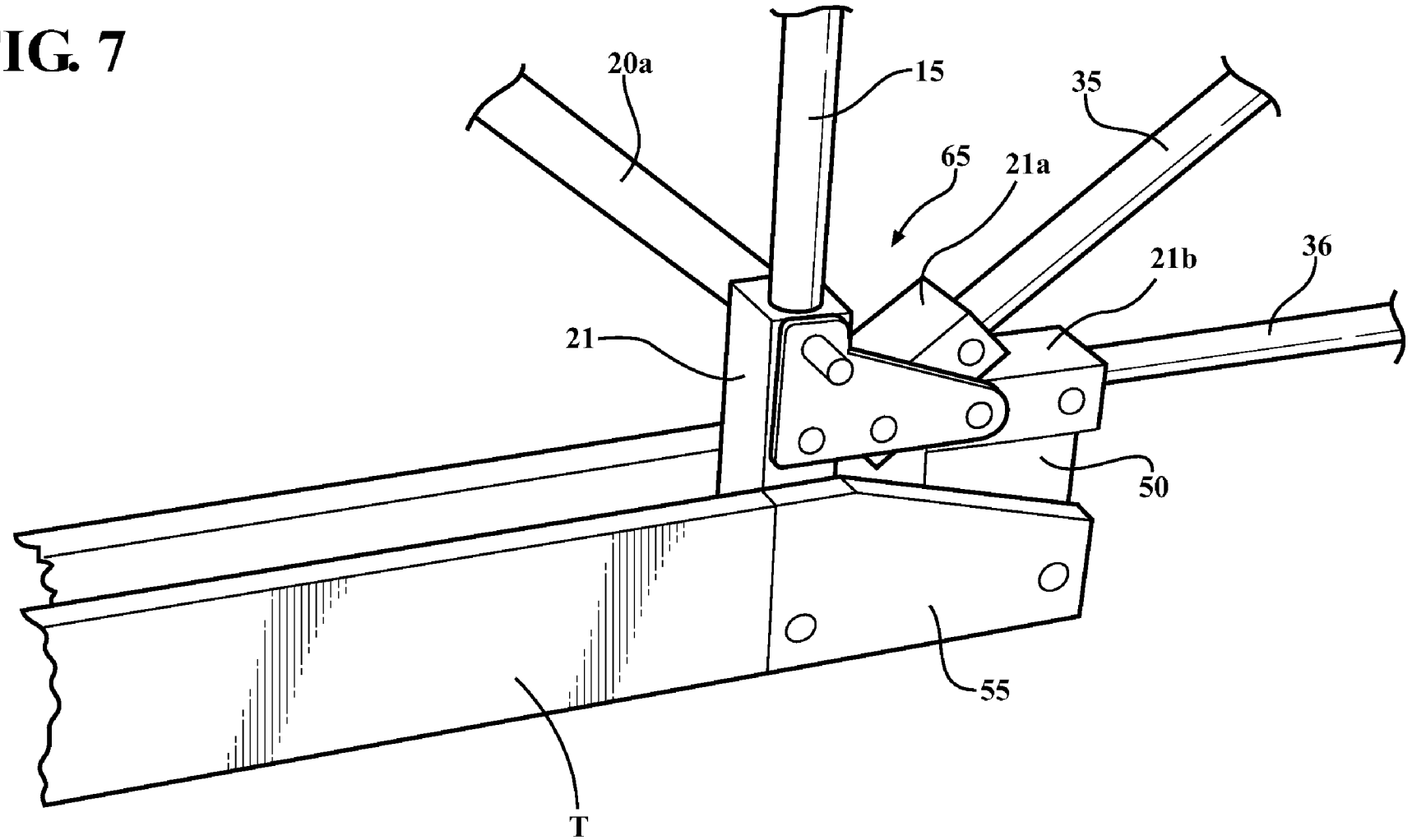
FIG. 7 is a perspective view of the front pivot station landed in a front pivot guide structure near the bow of the boat when the frame is fully extended.
Figure 7A:
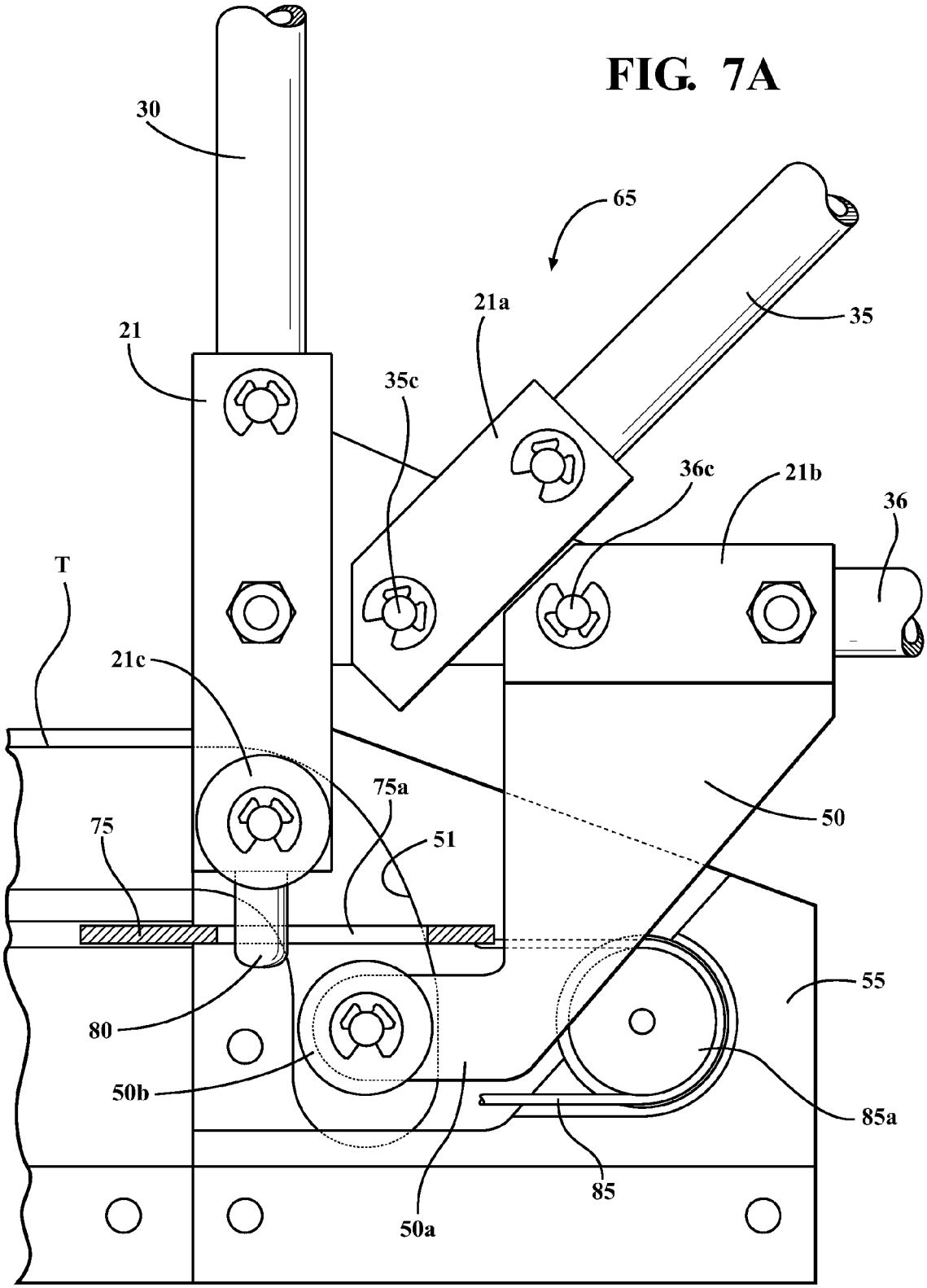
FIG. 7A is side elevation view of the front pivot station of FIG. 7.

FIGS. 7 and 7A show detail of the front pivot section (65) of the expanding frame (1) at the bow end of track T when the frame is in a fully extended position. The front pivot arm (50) is pivotally connected to pivot section (65) by pivot link (36*c*), and is shown engaging the front pivot guide (55) at the front end of the track apparatus (T). Front pivot guide (55) includes a downwardly-curved extension (51) of track (T) that cooperates with and guides a roller (50*b*) on an over-center elbow (50*a*) of pivot arm (50) to cause pivot arm (50) and the attached horizontal support (36) to rotate forward and down to a substantially horizontal position. Angled support (35) is mounted on a pivoting support block (21') pivotally connected to the pivot station (65) by a pivot link (35*c*), and is pulled into its angled deployment by the extension of the fabric effected by the horizontal deployment of horizontal support (36). As can be seen in FIG. 7A, the over-center rotation of pivot arm (50) into the curved slot (51) in the pivot guide (55) and the interacting faces of block (21*a*) and block portion (21*b*) of pivot arm (50) serve to latch the horizontal support (36) in its deployed horizontal position. Accordingly, when the front pivot arm (50) is engaged with the front pivot guide (55), the expanding frame (1) is in a locked position and cannot be moved by a heavy wind.

"Front" and "rear" as applied to the ends of the frame (1) and the associated pivot sections and stations should be considered interchangeable terms, since the respective pivot sections/stations could be applied to either end of the boat (5), although the motor/pivot station structure at the rear of the boat, and the associated rear cover storage position shown in FIG. 1, is preferred. Relational and shape-describing terms such as "U-shaped" and "horizontal" and "vertical" should be taken as meaning substantially or generally so, and include reasonable variations. It should be understood that while the details of the expanding frame/cover system are often described and illustrated herein from one side of the boat, both sides of the boat are equipped with the illustrated track, motor, travel block, and pivot station/section structures in order to expand and retract the cover evenly and smoothly. It might be possible, however, to use a single motor to power both sides of the track.

DESCRIPTION OF OPERATION

In operation, the frame (1) begins in the fully retracted storage position shown in phantom lines in FIG. 1, with the retracted frame tilted back away from the boat deck and the frame members (15) and (35) and (36) and fabric cover (90) secured in the retracted/collapsed state by a cover or straps (not shown), and with the rear pivot station (40) out of engagement with track (T) as shown in FIG. 6A. The stored frame (1) can be optionally secured relative to the boat (5) with suitable structure such as straps or detachable struts.

Rear pivot station portion (40) of frame (1) is then tilted to put the frame (1) in the vertical position shown in solid lines in FIG. 1, with rear pivot station (40) engaged with track (T) as shown in FIG. 6. Rear pivot section (65) is manually deployed so that rear horizontal support (36) is pivoted to a horizontal position against/adjacent the boat deck, and so that rear angled fabric support (35) is at approximately forty-five degrees from horizontal. Motor (70) is then started to begin driving the forward U-shaped support member (15) and front pivot sections (65) forward in tracks (T) along the sides of the boat (5), as shown in the partially extended condition of FIG. 2.

When frame (1) is fully extended as shown in FIG. 3, the front pivot section (65) has engaged front pivot guide (55) to cause the front horizontal support member (36) to pivot down to the horizontal position over the bow of the boat's deck, and to cause the front angled fabric support member (35) to pivot down to its angled fabric supporting position partway between horizontal and vertical. The deck of pontoon boat (5) is now fully covered from the elements and protected from adverse storage conditions.

It will finally be understood that the disclosed embodiments represent presently preferred examples of how to make and use the claimed invention, but are intended to enable rather than limit the invention as defined by the claims. Variations and modifications of the illustrated examples in the foregoing written specification and drawings may be possible without departing from the scope of the invention as defined in the claims. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention is accordingly defined by the following claims:

What is claimed:

1. A cover system for a pontoon boat, said cover system comprising:

an expanding frame system attached to track apparatus running horizontally along starboard and port sides of the boat, the frame system comprising a plurality of U-shaped vertical support members slidingly mounted for fore and aft movement on the track apparatus, each U-shaped vertical support member comprising a vertical tube section on each side of the boat and an arch portion connecting the vertical tube sections across the width of the boat, the U-shaped tube sections interconnected by expansion scissors secured to lower ends of their respective vertical tube sections at a lower end and slidably secured to upper ends of their respective vertical tube sections at an upper end.

2. The cover system of claim 1, wherein the expansion scissors are slidably secured to the vertical tube sections with sliding sleeves.

3. The cover system of claim 1, wherein the arch portions of the U-shaped supports are attached to the vertical tube sections with movable joints to allow the expanding frame to extend and retract without binding if one side of the expanding frame advances at a faster rate than the other side.

4. The cover system of claim 1, further comprising a pivot section on each side of the expanding frame at each of the bow and stern ends of the expanding frame, the pivot section comprising a U-shaped angled fabric support pivotally attached to the pivot section to pivot to an angled position partway between horizontal and vertical, and a U-shaped horizontal support pivotally attached to the pivot section to pivot to a substantially horizontal position.

5. The cover system of claim 4, wherein the expanding frame further comprises a pivot station pivotally engageable and disengageable with the track at an end of the boat, the pivot station adapted to retain all of the U-shaped support members when the expanding frame is fully retracted and to pivot the retracted U-shaped support members out of engagement with the track to a storage position at the end of the boat.

6. The cover system of claim 5, wherein the vertical tube sections of the first and last U-shaped vertical support members include springs connected to the pivot sections.

7. The cover system of claim 4, the front pivot section comprising a front pivot arm and front pivot guide, the front pivot arm located at the base of the front side of the expanding frame system, the front pivot arm mounted to travel in the track apparatus when the expanding frame is expanding or retracting, the front pivot guide located at the front end of the track apparatus to engage the front pivot arm when the expanding frame reaches full extension, the front pivot arm adapted to engage the front pivot guide to pivot the horizontal and angled supports and to latch the front of the fully extended cover to the boat.

8. The cover system of claim 4, the rear pivot section comprising a rear link, the rear link attached to the sliding sleeve on the rearmost vertical tube section at one end and to the horizontal tube section of the rear pivot section at the other end to automatically pivot the rear pivot section in response to the upward and downward motion of the sliding sleeve and latch the rear pivot when the cover is in an extended position to secure the rear of the cover to the boat.

9. The cover system of claim 4, comprising a power transmission between a motor located at a rear end of the track apparatus and a front pivot guide, the power transmission operatively connected to drive the vertical tube section.

10. The cover system of claim 1, further comprising a motorized transmission system that extends and retracts the said expanding frame system.

11. The cover system of claim 1, wherein the frame comprises a pivot station with a pivot connection to the track apparatus allowing the retracted frame to pivot to a rear storage position when the frame is retracted into the pivot station.

12. The cover system of claim 1, wherein said expanding frame further comprises a flexible fabric cover, said flexible fabric cover being expandable and retractable with the frame.

13. The cover system of claim 12, wherein said flexible fabric cover comprises a plurality of fabric stays that cause the flexible fabric cover to unfold and fold during expansion and retraction of the frame.

* * * * *